United States Patent [19]

Plummer

[11] 4,338,909

[45] Jul. 13, 1982

[54] ARCHERY BOW CONSTRUCTION

[76] Inventor: Marvin E. Plummer, 615 N. Decant Rd., Oregon, Ohio 43616

[21] Appl. No.: 147,389

[22] Filed: May 7, 1980

[51] Int. Cl.[3] ..... F41B 5/00

[52] U.S. Cl. ..... 124/16; 124/88; 124/23 R

[58] Field of Search ..... 124/16, 23 R, 24 R, 124/25, 41 A, 88, 22

[56] References Cited

U.S. PATENT DOCUMENTS 1,932,195 10/1933 Stroup ..... 124/23 R X 3,552,373 1/1971 Van Hecke ..... 124/24 R

FOREIGN PATENT DOCUMENTS 980014 12/1980 France ..... 124/25

*Primary Examiner*—Richard C. Pinkham

*Assistant Examiner*—William R. Browne

*Attorney, Agent, or Firm*—Paul F. Stutz

[57] ABSTRACT

Unique bow structure formed of three lengths of light weight tubular material and inclusive of a primary beam member, having removably but hingedly secured thereto, two identical lever arms having end extremities connected to the adjacent end extremity of the beam member by a spring-like member, said end extremities of lever arms being spanned by a bow string, maintained in tension in the static position and an even greater tension when the bow string is pulled back together with an associated arrow at the mid region of said bow string.

7 Claims, 6 Drawing Figures

ARCHERY BOW CONSTRUCTION

The present invention relates generally to the sport of archery. More particularly, the present invention relates to a bow structure designed to provide an extremely economical but extremely efficient operation and having an extremely high but uniform spring rate considering its relatively small size and cost as well as, and perhaps most importantly, simplicity.

Traditionally, archery bows are formed of a single piece of wood, a plurality of pieces of wood in laminated but glued, unitary assembly or fiberglass reinforced polyester or the like. The contour or configuration of the essentially one-piece unitary structure is designed to possess a bending flexibility calculated to yield a desired resistance to bending as the associated bow string is pulled rearwardly or, stated another way, in a direction opposite to that desired for the projectile arrow. The strength, weight or size of bows are thus calibrated, ranging from as little as about twenty (20) pounds up to one hundred (100) pounds and even higher. The number of pounds, of course, refers to the quantity of pull on the bow string which is necessary to cause the bow to yield to the desired preselected arrow release point. In turn, of course, the higher pull bows will be able to propel either a heavier arrow or a heavier arrow farther and with more force as necessary in the hunting of big game. In target archery, the higher number corresponds to a longer range or higher speed leading to greater accuracy.

The construction or fabrication of one-piece bows capable of exhibiting the flex, stress, spring capabilities, as above described, entails considerable expense and, consequently, high performance bows having desirable uniform spring characteristics are quite expensive. One-piece bows also, especially in the high performance range, are quite heavy and cumbersome which factors adversely effect the archer and his consistent accuracy.

Recognizing some of these deficiencies, multi-component bows or bows made of several members featuring external spring means and hinge means have been developed. See, for example, U.S. Pat. Nos. 586,712 (1897), 428,912 (1890), 3,957,022, 1,932,195 and 2,116,650. Certain of these patents disclose bow structures of more than one piece. A brief comparison of the drawings in these patents and those accompanying the present application will, however, reveal the obvious differences amongst which are complicatedness vs. simplicity, cumbersomeness vs. clarity and others as will reveal themselves from a closer comparison of the patent disclosure and the explanation and description set forth hereinafter.

It is, accordingly, a general object of the present invention to provide an archery bow structure of extremely simple design and accompanying low cost of manufacture and, accordingly, economical availability to the public.

It is another object of the present invention to provide a bow structure which is quite small in overall size yet capable of performance belying that size and, in fact, otherwise associated with much larger dimensions.

It is another object of the present invention to provide such a bow structure which additionally embodies uniformity of performance yet being capable of enduring handling and treatment which would destroy or adversely effect performance or uniformity of performance of bows known heretofore.

It is a significant object of the present invention to provide an archery bow design embodied in several principal elements and having interdependent cooperative regions of assembly which accommodate marketing of the bow in unassembled and/or kit form adding to or contributing to the economy of acquisition.

It is a major object of the present invention to provide a novel archery bow construction of interdependent components and which combines smallness, simplicity of design, low cost and yet be yieldative of operational performance normally expected of much larger conventional sized archery bows and possessed of a spring rate or "pull" consistency normally associated with extremely expensive and/or exotic archery bows.

The foregoing, as well as other objects of the present invention, will become apparent to those skilled in the art from the following detailed description taken in conjunction with the annexed sheet of drawings on which there is presented, for purposes of illustration only, a single embodiment of the archery bow structure of the present invention.

IN THE DRAWINGS

Figure 1:
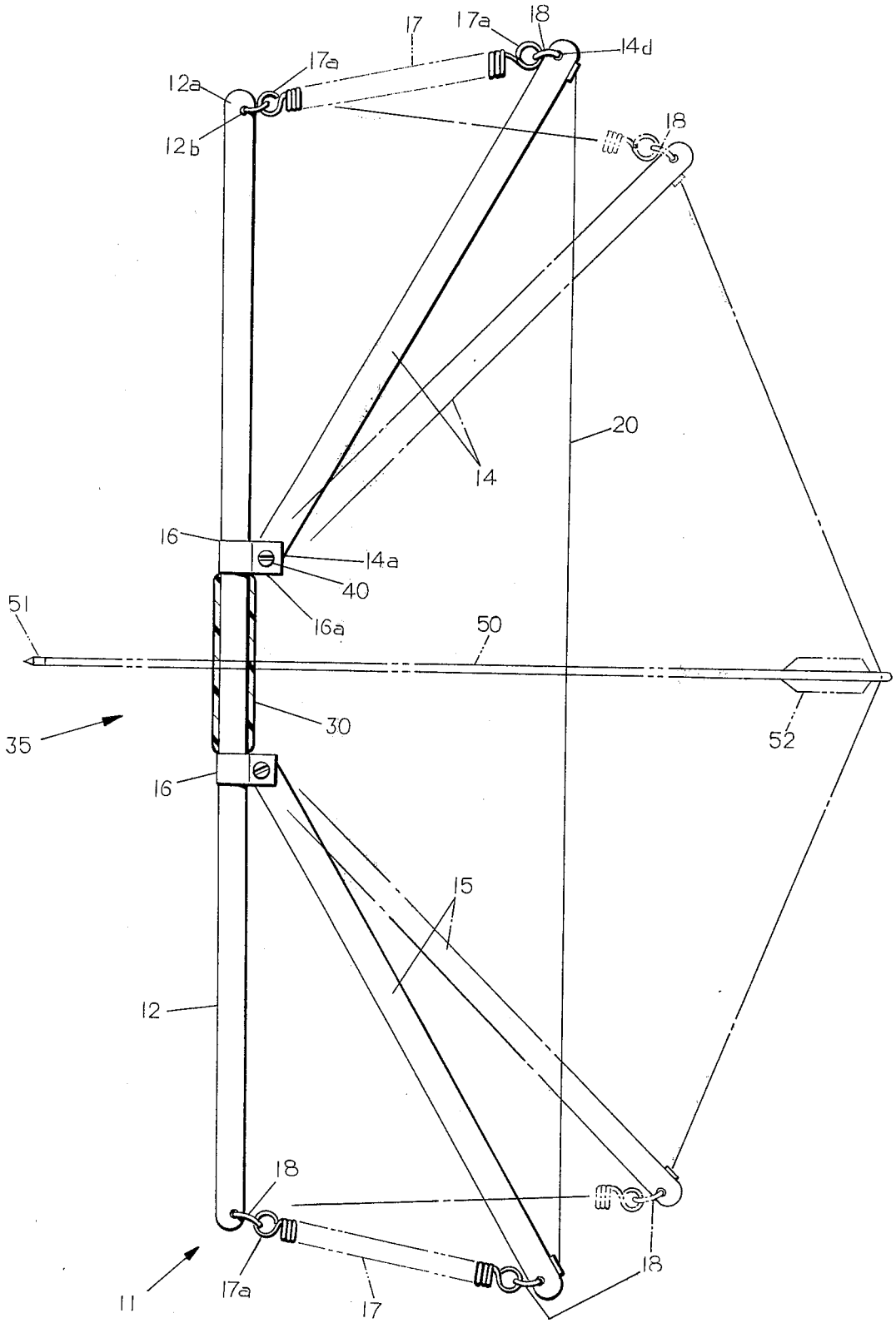
FIG. 1 is a side elevation view, partly in section, of the preferred archery bow, shown in solid outline in its normal state and in dotted outline in its extended state; that is, in a state of operational tension ready to release an arrow projectile.
Figure 2:
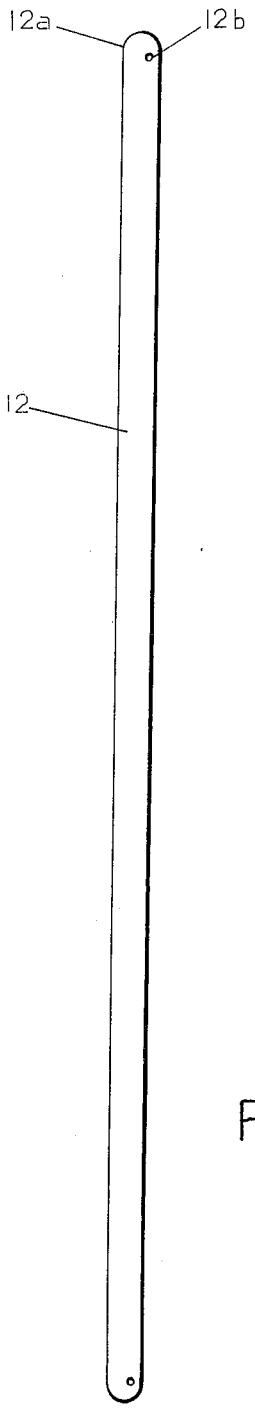
FIGS. 2 and 3 are side elevation views of several components of the archery bow structure in unassembled form for purposes of showing details of structure obscured in FIG. 1.
Figure 3:
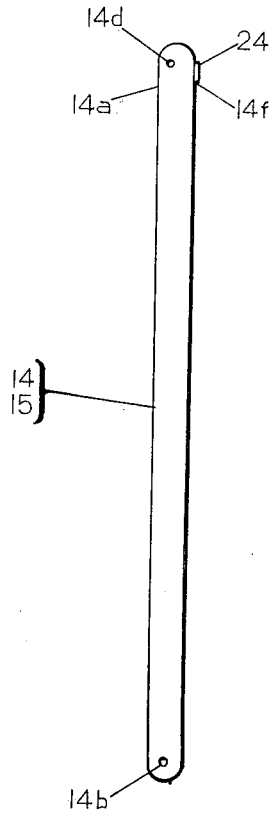

Returning now specifically to the drawings, the archery bow structure, identified by the reference numeral 11, will be described with specific and particular reference to preferred components and members employed in forming the archery bow.

Reference numeral 12 identifies an elongate primary beam or anchor member consisting of a twenty four and one-half inch (24½") length of one-half inch (178 ") inside diameter conduit normally and frequently employed in electrical wiring installation. The terminal cut ends 12*a* are open but the edges are deformed inwardly to avoid sharp edges and provided with transverse holes 12*b* for a purpose to be described. Rather than deforming or binding, apertured plastic plugs or caps can be used to cover sharp edges.

Figure 5:
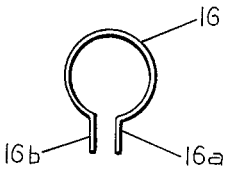
FIG. 5 is an end view of one component of the assembly making up the archery bow of this invention.

Reference numerals 14 and 15 identify identical pivot arms formed of one-half inch (½") inside diameter electrical conduit. The arms 14 and 15 are desirably formed of the same one-half inch (½") conduit but seventeen and one-half inches (17½") in length and are provided with rounded distal ends 14*a* and transverse holes 14*b*, as shown. Pivot member 14 is hingedly secured to primary beam member 12 employing one-half inch (½") water pipe hanger 16 formed to encircle the principal member 12 and with ear portions 16*a* (FIG. 5), each containing matching holes 16*b* to enclose the end 14*a* of the pivot arm 14 which likewise contains a three-sixteenth inch (3/16") hole 14*b* registering with the holes 16*b* in the ear portions 16*a* of the pipe hangers 16 whereby bolt 40 and acorn 41 permits securement in the manner shown. Pivot arm 15 is similarly secured to the primary member 12 at a distance equidistantly from the center and ends of member 12. The distal ends of pivot arms 14 and 15 are provided with holes 14*d*. A linear seven inch (7") by one-half inch (7"×½") expansion spring 17 having terminal circular hooks 17*a* is secured by appropriate hog ring or squeeze clips 18 to the terminal end 12*a* of beam member 12 and the outer end 14*a* of pivot arm 14 and, in similar fashion, identical spring 17 is secured to the terminal ends of beam member 12 and the distal end of pivot arm 15 in the manner shown. A forty two inch (42") length of one-eighth inch (⅛") diameter nylon string, identified by the reference numeral 20, is secured in tension to the distal ends of the pivot arms 14 and 15 to complete the archery bow structure. It has been found that a nylon having a tensile strength of four hundred pounds (400 lbs.) is suitable for the intended purpose. It is important that the bow string 20 be secured with sufficient tension or tautness that the pivot arms 14 and 15 are sufficiently extended that the springs 17 are in a significant state of tension as opposed to a slack or neutral state.

Reference numeral 30 identifies a combination hand-hold and spacer member shown in section in FIG. 1. The combination hand-hold and spacer 30 is preferably fabricated of a length of plastic water pipe measuring eleven-sixteenth inches (11/16") inside diameter and about seven-eighth inches (⅞") outside diameter which dimensions provide a snug fit about the primary beam member 12, yet allowing it to be telescopically moved from one end of the beam to its central position, as shown. The plastic water pipe is formed of rigid polyvinyl chloride which has a surface which is comfortable as a hand gripping feature. The size, particularly the outside diameter, can be varied by selecting a thicker walled length of plastic water pipe to accommodate a larger or smaller hand to provide a more comfortable grip. Importantly, the hand grip member 30 is multi-functional in serving to provide a necessary function, namely of maintaining the water pipe hanger members 16 from sliding toward each other. This inward sliding would occur through the operation of the archery bow, as hereinafter described, if not for the positioning of the hand grip, spacer member 30 in the position as described. Clearly, movement of the pipe hanger member 16 would change the pivotal connection of one or both of the pivot arms 14 and 15 and, contemporaneously, vary the attitude of the springs to adversely effect the operation of the bow.

From the foregoing description, it can be appreciated that the components of which the archery bow of the present invention is composed, are readily available at low cost; further, that the number of elements or parts is minimal and, additionally, that the assemblement thereof, in the manner described herein and illustrated in the drawings, could not be more simple. Springs of different size and characteristics can be selected to vary the performance of the archery bow structure of the invention. At the same time, the diameter and length of the primary beam member and pivot arms can be varied either alone or in combination with the choice of springs to provide a considerable latitude in bow performance characteristics in accordance with the present invention.

A further and considerable advantage of the archery bow construction, in accordance with the present invention, resides in the utter simplicity and ease with which the elements can be assembled and disassembled requiring only a simple screwdriver and/or pliers to secure the pivot arms in the pipe hangers. At the same time, the space occupied by the components in disassemblement is minimal. The primary beam member and pivot arms would clearly fit into an arrow quiver along with the pipe hangers, bow string and springs. The springs, of course, can be completely removed or left attached at one end. Similarly, the pivot arms do not have to be completely removed but rather the pipe hanger loosened so that the arms can be folded alongside the beam member. Even the bow string can be left secured to one end of one of the pivot arms to provide a small package of parts for storage or travel.

Figure 4:
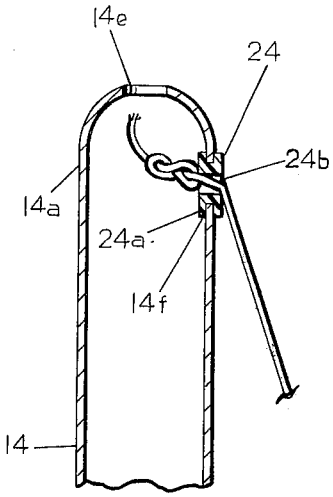
FIG. 4 is an enlarged elevation view of the terminal end of one of the components of the bow structure of the invention.
Figure 6:
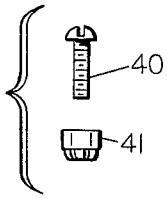
FIG. 6 is an elevation view of a threaded bolt and nut and to adjustably tighten the part of FIG. 5 onto the parts of FIGS. 2 and 3.

The bow string 20 is, as shown, secured to the terminal end of the pivot arm member 14 in the manner shown in FIG. 4. The end of the bow string 20 is threaded through a tiny hole (not shown) in a plug-like plastic fitment or eyelet 24 whereupon a figure-eight knot (as shown) is tied in the terminal end of the bow string which prevents it being withdrawn through the hole in the fitment. The opposite end of the bow string is then similarly threaded through the fitment and another figure-eight knot is tied in that terminal end of the bow string preventing its withdrawal through apertured fitment. Most conveniently, the springs, of one of them, is disconnected at one end so that the bow string is secured at both ends following which the spring can be secured, as described earlier herein, using the spring clips.

In FIG. 4, a distal end of one of the pivot arms is shown, somewhat enlarged, from which it can be seen that the end contains an axial aperture 14*e* and a side aperture 14*b*. The end aperture 14*e* permits an insertion of the plastic eyelet 24 therethrough for placement of the small end through aperture 14*f*, leaving the enlarged flange 24*a* inside preventing displacement. The other end 24*b* on the outside is deformed to secure the fitment preventing removal of the eyelet and, of course, serves to secure the bow string safely and without danger of fraying since the plastic eyelet has a smooth surface.

The operation of the novel bow construction of the present invention is basically no different than that of other bows. The space generally designated by the reference numeral 35, between the pipe hangers 14*a* and 14*b*, defines a hand-hold to the rear of which is situated the taut or tensioned bow spring 20 as drawn against the tension of the springs. At the same time, an arrow 50 is arranged with the pointed or projectile end 51 extending over the hand (not shown), usually gloved, or between the fingers of the user's hand in the hand-hold grasping position 40 of the primary member 12 while the opposite end 52 engages the bow string 20 which is extended to the degree desired, as indicated in the drawings by the dotted line representation of the pivot arms 14 and 15 and the dotted arm representation of the bow spring 20. Upon the release of the arrow and bow string, the identical spring members 17 will recoil from the extended state to the return position, shown in full line, causing the bow string to likewise return projecting the arrow in the direction guided by the aimed alignment of the arrow past the primary beam member 12 and the holding, guiding hand.

It is an important feature of the present invention that the exterior springs 17, in conjunction with the cooperating design and size parameters, provide a uniformity of spring recoil as contributes to uniformity of bow spring recoil and, contemporaneously, with a more uniform propelling force upon the arrow. This leads to increased accuracy and, at the same time, reduces the transition of the user from complete novice to a reasonable degree of accomplishment and skill.

Contemporaneously, it is important that the spring be selected in size, that is, length and diameter and, of course, spring rate, as to be in balanced performing relationship with the size of the other elements or components of the bow structure.

It has been found that a convenient size for the primary frame or beam member 12 is twenty four and one-half inches (24½") in length while the pivot arms are desirably seventeen and one-half inches (17½") in length; with both being formed of one-half inch (½") diameter galvanized electrical conduit.

With members of the foregoing dimensions, a hand-hold space of approximately five inches (5") will find the distal or remote ends of the lever arms extending slightly outwardly from the terminal or distal ends of the primary beam member 12. With this arrangement, the linear tension springs 16 and 17 are at a slight outward or obtuse angle with respect to the primary beam member 12, which arrangement is preferred and, in fact, essentially necessary in order to have the bow of this invention possess optimum performance characteristics. Most desirably, for optimum performance coupled with convenient size, the pivot arms are selected to have a length such that the springs define an acute angle with respect to the primary beam member 12 as measured between the adjacent distal ends of each.

Considering the preferred size of the primary beam member 12 and the pivot arms, it has been found most desirable that the associated linear springs each be seven inches (7") in length and one-half inch (½") in diameter, and, otherwise, be standard tension springs available from a variety of suppliers.

With the component parts of the bow structure assembled, as described herein, it is found that the springs are in a sufficient state of tension that sudden release from maximum extension or greatest "pull" will find the springs recoiling to a state still characterized as in tension. Properly assembled, the springs never return to a static or neutral position since this would be accompanied by considerable reaction manifested as a physical or manually felt shock which, while not particularly uncomfortable, would more importantly be accompanied by total failure of the arrow to receive the moment of recoil force necessary to propel the arrow in the desired manner and direction.

Thus, it is necessary in the selection of the size of the various components and the selection of the springs, that the spring or tension state always be maintained in order that the archery bow will be capable of performing in the desired fashion.

In accordance with a preferred embodiment of the present invention, the primary beam member and the pivot arm members are anodized in order to impart a pleasing coloration serving as a cosmetic and/or decorative affect while, at the same time, providing a protection against oxidation and rust attack of the surface of those members. Alternatively, a suitable primer and paint can be applied to the members by spray, brush or dipping to achieve the desired pleasing coloration and, at the same time, likewise provide protection against oxidation and rust deterioration of the members.

Any modification, changes or substitutions, as would be obvious to those skilled in the art, are intended to be included within the scope of the present invention unless specifically excluded by the language of the appended claims or unless such substitutions, modifications and/or changes would do violence to the language and meaning of the appended claims.

I claim:

1. An archery bow construction for propelling an arrow and embodying features of constructional simplicity, lightweight and compactness, said construction comprising:

a primary elongate beam member formed of lightweight tubular stock, first and second lever arms formed of lightweight tubular stock, means for securing said arms to said beam member in pivotal, adjustable, facily removable and spaced relationship on either side of the center of said elongate member as to define a hand-hold region, a tubular member telescopically surrounding said region for maintaining said spaced relationship between said lever arms, a bow string connecting the distal ends of said lever arms, first and second spring means connecting the distal ends of said lever arms to the adjacent distal ends of said elongate beam member, said spring means and bow string being adjusted and arranged so that springs and string are in tension but still allowing the bow string to be extended away from said elongate beam member causing angular, pivotal movement of said lever arms to define a lesser included angle and contemporaneous tensional extension of said first and second spring means, whereby sudden release of said bow string will allow contraction of said spring means to propel said arrow as urged by said bow string and recoiling spaced spring means and guided by said primary elongate beam member.

2. Invention as claimed in claim 1 wherein said lever arms have terminal or distal ends which extend beyond the distal or terminal ends of said beam member.

3. Invention as claimed in claim 1 wherein said means for securing said arms comprises a split circular band having end ear portions adapted to embrace an end of one of said lever arms and said ear portions and said lever arm ends being provided with holes which, in registry, receive an elongate bolt and nut assembly to tighten said assembly on said beam member.

4. Invention as claimed in claim 3 wherein said spring means comprise elongate coil springs having terminal integral rings or eyelets at each end adapted for releasably connecting said lever arms to said beam member.

5. Invention as claimed in claim 4 wherein said springs are selected as to size and inherent spring rate that operation of said bow, including release of said arrow, will cause recoil of said springs without said springs recoiling to a state of non-tension.

6. Invention as claimed in claim 1 wherein said construction is assembled to provide spring tension sufficient that operation of said bow, including release of said arrow, will cause recoil of said springs without said springs recoiling to the state of non-tension.

7. A "kit" composed of a plurality of interrelated parts in packaged array suitable for assembly to form an archery bow embodying features of constructional simplicity, light weight and compactness; said "kit" comprising means to enclose or surround said parts to form a package and said parts being located therein;

a primary elongate beam member formed of light-weight tubular stock, first and second lever arms formed of light-weight tubular stock, a pair of split circular bands, each having end ear portions adapted to embrace an end of one of said lever arms, said ear portions and said lever arm ends being provided with holes which, in registry, receive an elongate bolt and nut assembly to tighten said lever arms and assembly onto said beam member in spaced relationship to define a hand-hold region, a tubular member telescopically surrounding said region, for maintaining said spaced relationship between said split circular bands and connected lever arms, a bow string adapted to connect the distal ends of said lever arms, and first and second spring means adapted to connect the distal ends of said lever arms to the adjacent distal ends of said elongate beam member, said bow string being adapted to be attached to the distal ends of the respective lever arms, the attaching of the bow string placing the bow in a strung and tensioned condition, pivotal movement of said assembled lever arms, upon drawing of said bow string, tensioning said first and second spring means, and upon sudden release of said assembled bow string said springs propelling an arrow.

* * * * *